US012570920B2

(12) United States Patent
Iwai et al.

(10) Patent No.: US 12,570,920 B2
(45) Date of Patent: Mar. 10, 2026

(54) LUBRICATING OIL COMPOSITION, LUBRICATION METHOD, AND TRANSMISSION

(71) Applicant: IDEMITSU KOSAN CO., LTD., Tokyo (JP)

(72) Inventors: Toshiaki Iwai, Tokyo (JP); Masato Yokomizo, Tokyo (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 18/861,965

(22) PCT Filed: Apr. 17, 2023

(86) PCT No.: PCT/JP2023/015330
§ 371 (c)(1),
(2) Date: Oct. 31, 2024

(87) PCT Pub. No.: WO2023/214505
PCT Pub. Date: Nov. 9, 2023

(65) Prior Publication Data

US 2025/0290005 A1 Sep. 18, 2025

(30) Foreign Application Priority Data

May 6, 2022 (JP) ..... 2022-076436

(51) Int. Cl.

| | |
|---|---|
| ***C10M 169/04*** | (2006.01) |
| ***C10M 101/02*** | (2006.01) |
| ***C10M 135/36*** | (2006.01) |
| ***C10M 137/04*** | (2006.01) |
| ***C10M 137/10*** | (2006.01) |
| ***C10M 141/10*** | (2006.01) |
| *C10N 30/00* | (2006.01) |
| *C10N 30/02* | (2006.01) |
| *C10N 40/04* | (2006.01) |

(52) U.S. Cl.
CPC ..... *C10M 169/04* (2013.01); *C10M 101/02* (2013.01); *C10M 135/36* (2013.01); *C10M 137/04* (2013.01); *C10M 137/105* (2013.01); *C10M 141/10* (2013.01); *C10M 2203/1006* (2013.01); *C10M 2219/106* (2013.01); *C10M 2223/041* (2013.01); *C10M 2223/047* (2013.01); *C10N 2030/02* (2013.01); *C10N 2030/42* (2020.05); *C10N 2030/43* (2020.05); *C10N 2040/04* (2013.01)

(58) Field of Classification Search
CPC C10M 169/04; C10M 101/02; C10M 135/36; C10M 137/04; C10M 137/105; C10M 141/10; C10M 2203/1006; C10M 2219/106; C10M 2223/041; C10M 2223/047; C10N 2030/02; C10N 2030/42; C10N 2030/43; C10N 2040/04
See application file for complete search history.

(56) References Cited

U.S. PATENT DOCUMENTS

| | | | | |
|---|---|---|---|---|
| 11,208,610 | B2 * | 12/2021 | Aoki | C10M 137/04 |
| 2012/0277134 | A1 | 11/2012 | Deshimaru | |
| 2021/0292676 | A1 | 9/2021 | Kubo et al. | |
| 2021/0371766 | A1 | 12/2021 | Narita | |
| 2023/0120889 | A1 | 4/2023 | Matsubara et al. | |

FOREIGN PATENT DOCUMENTS

| | | | |
|---|---|---|---|
| CN | 111100736 | A | 5/2020 |
| JP | H11209776 | A | 8/1999 |
| JP | 2001348590 | A | 12/2001 |
| JP | 2008143927 | A | 6/2008 |
| JP | 2011140607 | A | 7/2011 |
| JP | 2021080429 | A | 5/2021 |
| WO | WO-2011080970 | A1 | 7/2011 |
| WO | WO-2020085153 | A1 | 4/2020 |
| WO | WO-2021193869 | A1 | 9/2021 |

OTHER PUBLICATIONS

International Search Report issued Jun. 20, 2023, in PCT/JP2023/015330 (with English translation), 7 pages.
Written Opinion of the International Searching Authority issued Jun. 20, 2023, in PCT/JP2023/015330 (with English translation), 8 pages.

* cited by examiner

*Primary Examiner* — Ellen M Mcavoy
(74) *Attorney, Agent, or Firm* — Element IP, PLC

(57) ABSTRACT

Provided are a lubricating oil composition including: a base oil (A); a sulfur-based extreme pressure agent (B); and a phosphorus-based extreme pressure agent (C), wherein the sulfur-based extreme pressure agent (B) is a thiadiazole having a branched organic group having 3 or more and 24 or less carbon atoms, and wherein the phosphorus-based extreme pressure agent (C) is a phosphate ester having a ring structure-containing organic group having 6 or more and 24 or less carbon atoms, a lubrication method including using the composition, and a transmission including the composition.

14 Claims, No Drawings

LUBRICATING OIL COMPOSITION, LUBRICATION METHOD, AND TRANSMISSION

TECHNICAL FIELD

The present invention relates to a lubricating oil composition, a lubrication method including using the lubricating oil composition, and a transmission including the lubricating oil composition.

BACKGROUND ART

In recent years, for the purpose of improving the fuel-saving property of a vehicle mounted with an automatic transmission, a reduction in viscosity of a lubricating oil composition to be used in the vehicle has been required. In addition, the fuel-saving property can be achieved by a reduction in size of the automatic transmission in addition to the reduction in viscosity of the lubricating oil composition. However, the reduction in size of the automatic transmission reduces the diameter of a toothed wheel to be used, and also reduces the face width thereof. Thus, a force to be applied to a tooth flank increases, and hence there has been a growing requirement for the gear-protecting property of a lubricating oil to be used in the transmission.

In addition, in an electrically driven vehicle, along with the integration of a motor and a transmission, there has been a growing requirement for double use of a cooling oil for the motor and a lubricating oil for the transmission. In such double use, to improve a fuel-saving property and to improve motor-cooling performance, there is a strong requirement for a reduction in viscosity.

To cope with those requirements, for example, a lubricating oil composition having added thereto a sulfur-based extreme pressure agent and a phosphorus-based extreme pressure agent has been investigated (Patent Literature 1).

CITATION LIST

Patent Literature

PTL 1: JP 2021-80429 A

SUMMARY OF INVENTION

Technical Problem

When a lubricating oil composition is reduced in viscosity, improvements in fuel-saving property and cooling property thereof can be achieved. However, the fluidity thereof becomes higher, and hence it becomes difficult to form the oil film of the lubricating oil composition on the surface of a tooth flank. In addition, when the tooth flank is locally overheated, a reduction in thickness of the oil film of the lubricating oil composition or the breakage thereof may occur owing to the reduction in viscosity of the lubricating oil composition. When the oil film on the surface of the tooth flank is reduced in thickness or breaks as described above, damage such as scuffing is liable to occur on the toothed wheel of a transmission. As described above, the reduction in viscosity of the lubricating oil composition is responsible for the occurrence of the damage of the gear. In other words, it can be said that the reduction in viscosity of the lubricating oil composition and the gear-protecting property of the lubricating oil composition including a scuffing-suppressing property are in a trade-off relationship.

In Patent Literature 1 described above, to improve a scoring property (having the same meaning as that of scuffing resistance in the present application), combined use of the sulfur-based extreme pressure agent and the phosphorus-based extreme pressure agent has been investigated. However, the lubricating oil composition of Patent Literature 1 has a large kinematic viscosity at 100° C., and hence does not cope with a requirement for a reduction in viscosity. In addition, it cannot be said that an improvement in scoring property is sufficient.

In addition, when the extreme pressure agents are added to the lubricating oil composition, the copper corrosion-preventing property and oxidation stability of the lubricating oil composition tend to reduce owing to the influences of these extreme pressure agents and decomposed products derived from the extreme pressure agents, though the tendency has not been investigated in Patent Literature 1.

An object of the present invention is to provide a lubricating oil composition, which achieves a more excellent copper corrosion-preventing property and more excellent oxidation stability while achieving both of a reduction in viscosity and a gear-protecting property at high levels, a lubrication method including using the lubricating oil composition, and a transmission including the lubricating oil composition.

Solution to Problem

To solve the above-mentioned problems, the inventors of the present invention provide the following items [1] to [15].

[1] A lubricating oil composition, comprising:

a base oil (A);

a sulfur-based extreme pressure agent (B); and a phosphorus-based extreme pressure agent (C), wherein the sulfur-based extreme pressure agent (B) is a thiadiazole having a branched organic group having 3 or more and 24 or less carbon atoms, and wherein the phosphorus-based extreme pressure agent (C) is a phosphate ester having a ring structure-containing organic group having 6 or more and 24 or less carbon atoms.

[2] The lubricating oil composition according to Item [1], wherein the base oil (A) has a kinematic viscosity at 100° C. of 6.000 $mm^2/s$ or less.

[3] The lubricating oil composition according to Item [1] or [2], wherein the base oil (A) contains a mineral oil, and a content of the mineral oil with respect to a total amount (100 mass %) of the base oil (A) is 70.00 mass % or more.

[4] The lubricating oil composition according to any one of Items [1] to [3], wherein the thiadiazole is a compound selected from compounds represented by the general formulae (B1) to (B3):

(B1)

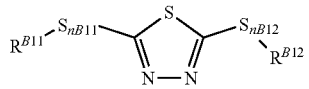

(B2)

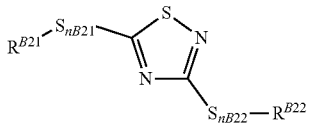

-continued (B3)

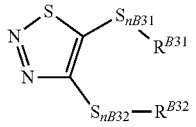

wherein in the general formulae (B1) to (B3), $R^{B11}$ to $R^{B32}$ each independently represent a branched organic group having 3 or more and 24 or less carbon atoms, and nB11 to nB32 each independently represent an integer of from 1 to 4.

[5] The lubricating oil composition according to any one of Items [1] to [4], wherein the ring structure-containing organic group having 6 or more and 24 or less carbon atoms of the phosphate ester is an aryl group that may have a substituent.

[6] The lubricating oil composition according to any one of Items [1] to [5], wherein the phosphate ester is free from being an amine salt.

[7] The lubricating oil composition according to any one of Items [1] to [6], wherein the phosphate ester is a neutral phosphate ester.

[8] The lubricating oil composition according to Item [7], wherein the neutral phosphate ester is a compound represented by the general formula (C1):

(C1)

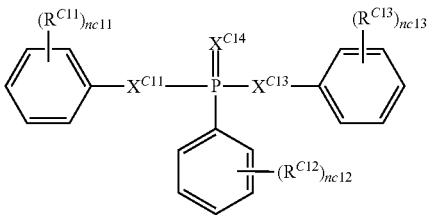

wherein in the general formula (C1), $R^{C11}$ to $R^{C13}$ each independently represent a hydrocarbon group having 1 or more and 24 or less carbon atoms, and —$CH_2$-s in the hydrocarbon group may each independently be substituted with —O—, —S—, —CO—, or —CS—, nC11 to nC13 each independently represent an integer of from 0 to 5, and when a plurality of $R^{C11}$s, $R^{C12}$s, or $R^{C13}$s are present in the same molecule, the plurality of groups may be identical to or different from each other, $X^{C11}$ to $X^{C13}$ each independently represent —O— or —S—, and $X^{C14}$ represents =O or =S.

[9] The lubricating oil composition according to any one of Items [1] to [8], wherein a sulfur atom content in the lubricating oil composition is 0.01 mass % or more and 0.20 mass % or less with respect to a total amount (100 mass %) of the lubricating oil composition.

[10] The lubricating oil composition according to any one of Items [1] to [9], wherein a phosphorus atom content in the lubricating oil composition is 0.005 mass % or more and 0.100 mass % or less with respect to a total amount (100 mass %) of the lubricating oil composition.

[11] The lubricating oil composition according to any one of Items [1] to [10], wherein a mass ratio (S/P ratio) between sulfur atoms and phosphorus atoms in the lubricating oil composition is 1.00 or more and 7.00 or less.

[12] The lubricating oil composition according to any one of Items [1] to [11], wherein the lubricating oil composition has a kinematic viscosity at 100° C. of 6.000 $mm^2/s$ or less.

[13] The lubricating oil composition according to any one of Items [1] to [12], wherein the lubricating oil composition is used for a transmission.

[14] A lubrication method, comprising using the lubricating oil composition of any one of Items [1] to [13].

[15] A transmission, comprising the lubricating oil composition of any one of Items [1] to [13].

Advantageous Effects of Invention

According to the present invention, the lubricating oil composition, which achieves a more excellent copper corrosion-preventing property and more excellent oxidation stability while achieving both of a reduction in viscosity and a gear-protecting property at high levels, the lubrication method including using the lubricating oil composition, and the transmission including the lubricating oil composition can be provided.

DESCRIPTION OF EMBODIMENTS

An embodiment of the present invention (hereinafter sometimes referred to as "this embodiment") is described below. In this description, the numerical values of an upper limit and a lower limit related to numerical ranges represented by the terms "or more" and "or less," and the symbol "~" are numerical values that may be arbitrarily combined, and the numerical values of Examples may be used as the numerical values of the upper limit and the lower limit.

A lubricating oil composition, a lubrication method including using the lubricating oil composition, and a transmission including the lubricating oil composition according to this embodiment are each merely one embodiment of the present invention, and the present invention is not limited thereto.

[Lubricating Oil Composition]

A lubricating oil composition of this embodiment includes a base oil (A), a sulfur-based extreme pressure agent (B), and a phosphorus-based extreme pressure agent (C). It is required that the sulfur-based extreme pressure agent (B) be a thiadiazole having a branched organic group having 3 or more and 24 or less carbon atoms, and that the phosphorus-based extreme pressure agent (C) be a phosphate ester having a ring structure-containing organic group having 6 or more and 24 or less carbon atoms.

The lubricating oil composition of this embodiment includes the sulfur-based extreme pressure agent (B) having a specific structure and the phosphorus-based extreme pressure agent (C) having a specific structure together with the base oil (A), and hence the composition can achieve a more excellent copper corrosion-preventing property and more excellent oxidation stability while achieving both of a reduction in viscosity and a gear-protecting property at high levels. When the sulfur-based extreme pressure agent (B) having a specific structure and the phosphorus-based extreme pressure agent (C) having a specific structure are used as described above, in addition to an effect as an extreme pressure agent, a high gear-protecting property is expressed, and a copper corrosion-preventing property and oxidation stability can be achieved even in a lubricating oil composition reduced in viscosity.

The term "reduction in viscosity" as used herein means that the value of the kinematic viscosity of the lubricating oil composition at 100° C. is reduced, and specifically, the kinematic viscosity is preferably 6.000 $mm^2/s$ or less. The kinematic viscosity at 100° C. may be determined by a method described in Examples.

As described above, the lubricating oil composition of Patent Literature 1 has a large kinematic viscosity at 100° C. To recognize that the kinematic viscosity has been alleviated in the lubricating oil composition of this embodiment, the inventors have paid attention to its kinematic viscosity at 100° C.

A gear causes scuffing (scoring), spalling, pitting, and wear when used. The term "gear-protecting property" includes scuffing resistance and means the property by which the damage of a toothed wheel or the like in the gear is prevented from occurring or suppressed. The term "scuffing resistance" means the property by which local surface damage (scuffing) due to solid phase fusion occurring on the sliding contact surface of the tooth flank or the like of the toothed wheel is alleviated. As described above, the reduction in viscosity and the gear-protecting property are in a trade-off relationship, and in this embodiment, both of the reduction and the property can be achieved at high levels by using the sulfur-based extreme pressure agent (B) having a specific structure and the phosphorus-based extreme pressure agent (C) having a specific structure together with the base oil (A). Although the reason for the foregoing is unclear, a possible reason is as follows: when the sulfur-based extreme pressure agent (B) and the phosphorus-based extreme pressure agent (C) are used, the surface of the metal of a transmission serving as an object to be lubricated, in particular, a metal having fine unevenness on its surface is coated, and hence the oil film-forming property of the lubricating oil composition and the oil film-forming ability thereof (hereinafter also referred to as "oil film formability") can be improved. When the oil film formability is high, it is conceivable that impact or solid phase fusion between metals can be suppressed by an oil film, and hence a high gear-protecting property can be obtained. In addition, the sulfur-based extreme pressure agent (B) having a specific structure and the phosphorus-based extreme pressure agent (C) having a specific structure may express an excellent copper corrosion-preventing property and excellent oxidation stability.

The "gear-protecting property" is the property by which local surface damage due to solid phase fusion occurring on, for example, the tooth flank of a toothed wheel is alleviated. The property may be evaluated by, for example, the observation of a wear scar caused by a shell four-ball wear test in conformity with ASTM D4172-18 described in Examples and the diameter of the wear scar. The fact that the surface damage occurs can be recognized from the observation of the wear scar, and the extent of the damage can be recognized from the size of the wear scar diameter. As the wear scar diameter becomes smaller, the "gear-protecting property" can be evaluated to be higher.

In addition, the "copper corrosion-preventing property" and the "oxidation stability" each serve as an indicator of the evaluation of whether or not the lubricating oil composition chemically affects the object to be lubricated or the lubricating oil composition is chemically affected by the object to be lubricated. As described above, the addition of the sulfur-based extreme pressure agent or the phosphorus-based extreme pressure agent can provide a high gear-protecting property. However, for example, the corrosion of the surface of the copper of the object to be lubricated occurs, or a metal on the surface of the object to be lubricated acts as a catalyst to cause the decomposition of the sulfur-based extreme pressure agent and the phosphorus-based extreme pressure agent. A case in which the metal is dissolved in the lubricating oil composition or a constituent therefor deteriorates as described above is not preferred because a reduction in original performance of the lubricating oil composition occurs. The lubricating oil composition of this embodiment has been able to suppress a reduction in performance of the lubricating oil composition through the combination of such components as described above. The "copper corrosion-preventing property" may be evaluated by, for example, a copper elution amount described in Examples, and the "oxidation stability" may be evaluated by, for example, an Indiana stirring oxidation test (ISOT test) described in Examples, and the amount of an increase in acid value of the composition before and after the ISOT test.

In the lubricating oil composition of this embodiment, to achieve a reduction in viscosity thereof and an improvement in gear-protecting property thereof, the lower limit value of the total content of the base oil (A), the sulfur-based extreme pressure agent (B), and the phosphorus-based extreme pressure agent (C) is preferably 60.00 mass % or more, more preferably 70.00 mass % or more, still more preferably 80.00 mass % or more, still further more preferably 85.00 mass % or more, even more preferably 88.00 mass % or more, still even more preferably 89.00 mass % or more with respect to the total amount (100 mass %) of the lubricating oil composition. In addition, to express an excellent copper corrosion-preventing property and excellent oxidation stability, the upper limit value thereof is preferably 100 mass % or less, more preferably 99.00 mass % or less, still more preferably 97.00 mass % or less, still further more preferably 95.00 mass % or less, even more preferably 92.00 mass % or less.

A sulfur atom content in the lubricating oil composition is preferably 0.01 mass % or more and 0.20 mass % or less with respect to the total amount (100 mass %) of the lubricating oil composition because an excellent copper corrosion-preventing property and excellent oxidation stability can be achieved while the gear-protecting property of the composition is improved. The lower limit value of the content is more preferably 0.02 mass % or more, still more preferably 0.03 mass % or more. The upper limit value thereof is more preferably 0.15 mass % or less, still more preferably 0.10 mass % or less, still further more preferably 0.09 mass % or less.

A phosphorus atom content in the lubricating oil composition is preferably 0.005 mass % or more and 0.100 mass % or less with respect to the total amount (100 mass %) of the lubricating oil composition because an excellent copper corrosion-preventing property and excellent oxidation stability can be achieved while the gear-protecting property of the composition is improved. The lower limit value of the content is more preferably 0.010 mass % or more, still more preferably 0.013 mass % or more. The upper limit value thereof is more preferably 0.080 mass % or less, still more preferably 0.050 mass % or less, still further more preferably 0.035 mass % or less.

A mass ratio (S/P ratio) between sulfur atoms and phosphorus atoms in the lubricating oil composition is preferably 1.00 or more and 7.00 or less because the copper corrosion-preventing property can be particularly improved while the gear-protecting property is improved. A case in which the sulfur atom content and the phosphorus atom content fall within the above-mentioned ranges, and the S/P ratio falls within the range is more preferred. The lower limit value of the S/P ratio is more preferably 1.10 or more, still more preferably 1.15 or more. The upper limit value thereof is more preferably 6.50 or less, still more preferably 6.00 or less, still further more preferably 5.40 or less.

The sulfur atom content in the lubricating oil composition may be appropriately adjusted mainly by the content of the sulfur-based extreme pressure agent (B), and the phosphorus atom content in the lubricating oil composition may be appropriately adjusted mainly by the content of the phosphorous-based extreme pressure agent (C). Accordingly, the S/P ratio may also be appropriately adjusted by the contents of the sulfur-based extreme pressure agent (B) and the phosphorus-based extreme pressure agent (C).

To achieve an excellent fuel-saving property and excellent oil film formability, the upper limit value of the kinematic viscosity of the lubricating oil composition at 100° C. is preferably 6.000 $mm^2/s$ or less, more preferably 5.000 $mm^2/s$ or less, still more preferably 4.800 $mm^2/s$ or less, still further more preferably 4.500 $mm^2/s$ or less, even more preferably 4.100 $mm^2/s$ or less. The lower limit value thereof, which is not particularly limited, is preferably 2.000 $mm^2/s$ or more, more preferably 3.000 $mm^2/s$ or more, still more preferably 3.300 $mm^2/s$ or more, still further more preferably 3.600 $mm^2/s$ or more, even more preferably 3.800 $mm^2/s$ or more.

To achieve an excellent fuel-saving property and excellent oil film formability, the upper limit value of the kinematic viscosity of the lubricating oil composition at 40° C. is preferably 20.00 $mm^2/s$ or less, more preferably 18.00 $mm^2/s$ or less, still more preferably 16.50 $mm^2/s$ or less, still further more preferably 16.00 $mm^2/s$ or less, even more preferably 15.90 $mm^2/s$ or less. The lower limit value thereof, which is not particularly limited, is preferably 12.00 $mm^2/s$ or more, more preferably 13.00 $mm^2/s$ or more, still more preferably 14.00 $mm^2/s$ or more, still further more preferably 15.00 $mm^2/s$ or more, even more preferably 15.50 $mm^2/s$ or more.

To achieve an excellent fuel-saving property and excellent oil film formability, the upper limit value of the viscosity index of the lubricating oil composition is preferably 180 or less, more preferably 175 or less, still more preferably 170 or less, still further more preferably 167 or less. The lower limit value thereof, which is not particularly limited, is preferably 130 or more, more preferably 140 or more, still more preferably 145 or more, still further more preferably 150 or more, even more preferably 155 or more.

As described above, the gear-protecting property was evaluated by the observation of a wear scar caused by the shell four-ball wear test and the diameter of the wear scar. The upper limit value of the wear scar diameter is preferably 0.65 mm or less, more preferably 0.63 mm or less, still more preferably 0.60 mm or less, still further more preferably 0.58 mm or less, even more preferably 0.55 mm or less. The lower limit value thereof, which is not particularly limited, is generally about 0.30 mm.

As described above, the oxidation stability is evaluated under the conditions of the ISOT test by measuring an acid value increase on the basis of an increase in acid value of the lubricating oil composition before and after the test. The upper limit value of the acid value increase is preferably 0.20 or less, more preferably 0.15 or less, still more preferably 0.12 or less, still further more preferably 0.10 or less. Although the lower limit value thereof is not particularly limited, a value of about 0.01 generally causes no problems in practical use.

For the copper corrosion-preventing property, the upper limit value of the copper elution amount is preferably 50 mass ppm or less, more preferably 45 mass ppm or less, still more preferably 40 mass ppm or less, still further more preferably 38 mass ppm or less. Although the lower limit value thereof is not particularly limited, a value of about 5 mass ppm or more generally causes no problems in practical use.

<Base Oil (A)>

The base oil (A) to be used in this embodiment may be a mineral oil or may be a synthetic oil, or a mixed oil of the mineral oil and the synthetic oil may be used.

Examples of the mineral oil include: a normal-pressure residual oil obtained by distilling a crude oil, such as a paraffin-based crude oil, an intermediate base crude oil, or a naphthene-based crude oil, under normal pressure; a distillate oil obtained by distilling such normal-pressure residual oil under reduced pressure; and a mineral oil obtained by subjecting the distillate oil to one or more kinds of refining treatment, such as solvent deasphalting, solvent extraction, hydrocracking, solvent dewaxing, contact dewaxing, and hydrofining.

In addition, from the viewpoint of achieving a low friction coefficient and improving copper corrosion resistance, a mineral oil corresponding to one of a group II or III in the base oil category of the American Petroleum Institute (API) is preferably used as the mineral oil. Mineral oils corresponding to the group II and the group III are more preferably used in combination.

Examples of the synthetic oil include: poly-α-olefins, such as polybutene, an ethylene-α-olefin copolymer, and an α-olefin homopolymer or copolymer; various ester oils, such as a polyol ester, a dibasic acid ester, and a phosphate ester; various ethers such as polyphenyl ether; a polyglycol; an alkylbenzene; an alkylnaphthalene; and a GTL base oil obtained by isomerizing a wax (gas-to-liquids wax (GTL wax)) produced from a natural gas by a Fischer-Tropsch process.

One kind of the mineral oils and the synthetic oils may be used alone as the base oil (A), a plurality of kinds of the mineral oils may be used in combination, or a plurality of kinds of the synthetic oils may be used in combination. Alternatively, the mineral oils and the synthetic oils may be used in combination.

The base oil (A) contains the mineral oil, and the lower limit value of the content of the mineral oil with respect to the total amount (100 mass %) of the base oil (A) is preferably 70.00 mass % or more, more preferably 80.00 mass % or more, still more preferably 90.00 mass % or more, still further more preferably 95.00 mass % or more, even more preferably 98.00 mass % or more. The base oil is still even more preferably formed substantially only of the mineral oil.

Although the viscosity of the base oil (A) is not particularly limited, the lower limit value of the kinematic viscosity thereof at 40° C. is preferably 8.000 $mm^2/s$ or more, more preferably 10.000 $mm^2/s$ or more, still more preferably 13.000 $mm^2/s$ or more. The upper limit value thereof is preferably 20.000 $mm^2/s$ or less, more preferably 17.500 $mm^2/s$ or less, still more preferably 14.500 $mm^2/s$ or less.

The upper limit value of the kinematic viscosity of the base oil (A) at 100° C. is preferably 6.000 $mm^2/s$ or less, more preferably 5.500 $mm^2/s$ or less, still more preferably 5.000 $mm^2/s$ or less. The lower limit value thereof is preferably 2.000 $mm^2/s$ or more, more preferably 2.500 $mm^2/s$ or more, still more preferably 3.000 $mm^2/s$ or more.

The lower limit value of the content of the base oil (A) with respect to the total amount (100 mass %) of the lubricating oil composition is preferably 70.00 mass % or more, more preferably 80.00 mass % or more, still more preferably 85.00 mass % or more. The upper limit value thereof is preferably 99.00 mass % or less, more preferably 95.00 mass % or less, still more preferably 92.00 mass % or less. A case in which the content of the base oil (A) is set within the above-mentioned ranges is preferred because the base oil acts together with the sulfur-based extreme pressure agent (B) and the phosphorus-based extreme pressure agent (C) to be described later to facilitate the achievement of a more excellent copper corrosion-preventing property and more excellent oxidation stability while achieving both of a reduction in viscosity of the composition and the gear-protecting property thereof at high levels.

<Sulfur-Based Extreme Pressure Agent (B)>

The sulfur-based extreme pressure agent (B) to be used in this embodiment needs to be a thiadiazole having a branched organic group having 3 or more and 24 or less carbon atoms. This case is preferred because a more excellent copper corrosion-preventing property and more excellent oxidation stability are easily achieved while both of a reduction in viscosity of the lubricating oil composition and the gear-protecting property thereof are achieved at high levels.

The thiadiazole having the branched organic group having 3 or more and 24 or less carbon atoms may have an excellent copper corrosion-preventing property and excellent oxidation stability because of the following reason: the thiadiazole has a substituent that is sterically congested as compared to a thiadiazole having a linear organic group, and hence a metal having a catalytic action hardly approaches a reactive site, and probably as a result of the foregoing, the thiadiazole is hardly affected.

To express the above-mentioned characteristics, the branched organic group only needs to have a branched portion, and is preferably a branched alkyl group, a branched alkenyl group, or a branched alkynyl group. The branched alkyl group, the branched alkenyl group, or the branched alkynyl group may have —O—, —CO—, —COO—, —OCO—, —S—, —$S_2$—, —$S_3$—, —$S_4$—, —CS—, —C(=S)O—, —C(=O)S—, —SC(=S)—, —NH—, —NHCO—, or —C(=O) NH—. The branched organic group is preferably the branched alkyl group or the branched alkenyl group, more preferably the branched alkyl group. The branched organic group has preferably 5 or more and 20 or less carbon atoms, more preferably 6 or more and 18 or less carbon atoms, still more preferably 7 or more and 15 or less carbon atoms, still further more preferably 8 or more and 13 or less carbon atoms, even more preferably 9 or more and 12 or less carbon atoms.

The branched organic group is preferably a substituent represented by the general formula (B0). The term "branched" in the branched alkyl group merely means that the "alkyl group" has a branched chain.

(B0)

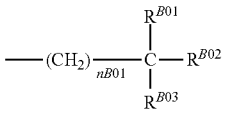

wherein in the general formula (B0), $R^{B01}$ and $R^{B02}$ each independently represent an alkyl group having 1 to 22 carbon atoms, $R^{B03}$ represents a hydrogen atom or an alkyl group having 1 to 21 carbon atoms, and nB01 represents an integer of from 0 to 20.

$R^{B01}$ represents preferably a linear alkyl group having 1 to 22 carbon atoms, more preferably a linear alkyl group having 1 to 8 carbon atoms, still more preferably a methyl group, an ethyl group, or a n-propyl group, still further more preferably a methyl group or an ethyl group, even more preferably a methyl group.

$R^{B02}$ represents preferably a linear alkyl group having 1 to 22 carbon atoms, more preferably a linear alkyl group having 3 to 12 carbon atoms, still more preferably a linear alkyl group having 6 to 10 carbon atoms, still further more preferably a linear alkyl group having 6 to 9 carbon atoms.

$R^{B03}$ represents preferably a hydrogen atom or a linear alkyl group having 1 to 22 carbon atoms, more preferably a hydrogen atom or a linear alkyl group having 1 to 8 carbon atoms, still more preferably a methyl group, an ethyl group, or a n-propyl group, still further more preferably a methyl group or an ethyl group, even more preferably a methyl group.

nB01 represents preferably an integer of from 0 to 8, more preferably an integer of from 0 to 4, still more preferably an integer of from 0 to 2, still further more preferably 0 or 1, even more preferably 0.

The sulfur-based extreme pressure agent (B) is preferably a compound selected from compounds represented by the general formulae (B1) to (B3) because a more excellent copper corrosion-preventing property and more excellent oxidation stability are easily achieved while both of a reduction in viscosity of the lubricating oil composition and the gear-protecting property thereof are achieved at high levels. A compound represented by the general formula (B1) is more preferred.

(B1)

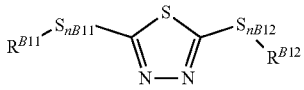

(B2)

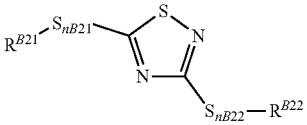

(B3)

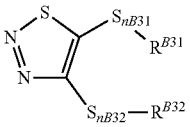

wherein in the general formulae (B1) to (B3), $R^{B11}$ to $R^{B32}$ each independently represent a branched organic group having 3 or more and 24 or less carbon atoms, and nB11 to nB32 each independently represent an integer of from 1 to 4.

Although $R^{B11}$ to $R^{B32}$ present in the same molecule may represent branched organic groups identical to each other or branched organic groups different from each other, branched organic groups identical to each other are preferred in terms of ease of availability. $R^{B11}$ to $R^{B32}$ each only need to have a branched portion, and each preferably represent a branched alkyl group, a branched alkenyl group, or a branched alkynyl group. The branched alkyl group, the branched alkenyl group, or the branched alkynyl group may have —O—, —CO—, —COO—, —OCO—, —S—, —$S_2$—, —$S_3$—, —$S_4$—, —CS—, —C(=S)O—, —C(=O)S—, —SC(=S)—, —NH—, —NHCO—, or —C(=O)NH—. The branched organic group is preferably the branched alkyl group or the branched alkenyl group, more preferably the branched alkyl group. The branched organic group has preferably 5 or more and 20 or less carbon atoms, more preferably 6 or more and 18 or less carbon atoms, still more preferably 7 or more and 15 or less carbon atoms, still further more preferably 8 or more and 13 or less carbon atoms, even more preferably 9 or more and 12 or less carbon atoms. The branched organic group is preferably the above-mentioned substituent represented by the general formula (B0).

nB11 to nB32 each independently represent preferably an integer of from 1 to 3, more preferably 1 or 2, still more preferably 2.

To obtain a more excellent gear-protecting property, the lower limit value of a sulfur atom content in the sulfur-based extreme pressure agent (B) is preferably 10.00 mass % or more, more preferably 20.00 mass % or more, still more preferably 30.00 mass % or more, and the upper limit value thereof is preferably 50.00 mass % or less, more preferably 40.00 mass % or less, still more preferably 36.00 mass % or less.

To improve the gear-protecting property of the lubricating oil composition, the lower limit value of the content of the sulfur-based extreme pressure agent (B) is preferably 0.01 mass % or more, more preferably 0.03 mass % or more, still more preferably 0.05 mass % or more, still further more preferably 0.08 mass % or more with respect to the total amount (100 mass %) of the lubricating oil composition. In addition, to express an excellent copper corrosion-preventing property and excellent oxidation stability, the upper limit value thereof is preferably 5.00 mass % or less, more preferably 3.00 mass % or less, still more preferably 2.00 mass % or less, still further more preferably 1.00 mass % or less, even more preferably 0.50 mass % or less, still even more preferably 0.30 mass % or less.

The content of sulfur atoms derived from the sulfur-based extreme pressure agent (B) is preferably 0.01 mass % or more and 0.20 mass % or less with respect to the total amount (100 mass %) of the lubricating oil composition because an excellent copper corrosion-preventing property and excellent oxidation stability can be achieved while the gear-protecting property is improved. The lower limit value of the content is more preferably 0.02 mass % or more, still more preferably 0.03 mass % or more. The upper limit value thereof is more preferably 0.15 mass % or less, still more preferably 0.10 mass % or less, still further more preferably 0.09 mass % or less.

<Phosphorus-Based Extreme Pressure Agent (C)>

The phosphorus-based extreme pressure agent (C) to be used in this embodiment needs to be a phosphate ester having a ring structure-containing organic group having 6 or more and 24 or less carbon atoms. This case is preferred because a more excellent copper corrosion-preventing property and more excellent oxidation stability are easily achieved while both of a reduction in viscosity of the lubricating oil composition and the gear-protecting property thereof are achieved at high levels.

Preferred examples of the phosphate ester include: phosphate esters, such as a neutral phosphate ester, an acidic phosphate ester, a phosphite ester, and a hydrogen phosphite ester; and amine salts of the phosphate esters. To achieve a more excellent copper corrosion-preventing property and more excellent oxidation stability while achieving both of the reduction in viscosity and the gear-protecting property at high levels, the phosphate ester is more preferably free from being an amine salt, and is still more preferably a neutral phosphate ester.

The phosphate ester having the ring structure-containing organic group having 6 or more and 24 or less carbon atoms may have an excellent copper corrosion-preventing property and excellent oxidation stability because of the following reason: the phosphate ester has a substituent that is sterically congested as compared to a ring structure-free phosphate ester having 6 or more and 24 or less carbon atoms, and hence a metal having a catalytic action hardly approaches a reactive site, and probably as a result of the foregoing, the phosphate ester is hardly affected.

The number of the carbon atoms of the ring structure-containing organic group is preferably 6 or more and 20 or less, more preferably 6 or more and 16 or less, still more preferably 6 or more and 14 or less, still further more preferably 6 or more and 11 or less, even more preferably 6 or more and 10 or less, particularly preferably 9.

To express the above-mentioned characteristics, the ring structure-containing organic group having 6 or more and 24 or less carbon atoms of the phosphate ester is preferably an aryl group that may have a substituent. When the group is the aryl group, the group contributes to steric hindrance, and the aryl group itself has high chemical stability. Probably because of the foregoing, an excellent copper corrosion-preventing property and excellent oxidation stability are expressed.

The aryl group is preferably a phenyl group, a naphthalen-1-yl group, or a naphthalen-2-yl group, more preferably a phenyl group. The aryl group may be unsubstituted or may have a substituent. The substituent is preferably an organic group having 1 or more and 18 or less carbon atoms, more preferably a hydrocarbon group having 1 or more and 18 or less carbon atoms, still more preferably an alkyl group having 1 or more and 18 or less carbon atoms, still further more preferably an alkyl group having 1 or more and 8 or less carbon atoms, even more preferably an alkyl group having 1 or more and 6 or less carbon atoms, still even more preferably an alkyl group having 1 or more and 4 or less carbon atoms.

The neutral phosphate ester is preferably a compound represented by the general formula (C1):

(C1)

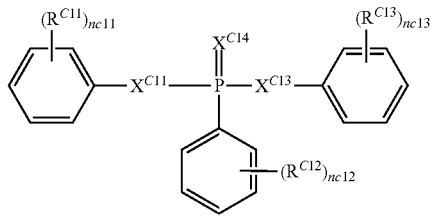

wherein in the general formula (C1), $R^{C11}$ to $R^{C13}$ each independently represent a hydrocarbon group having 1 or more and 24 or less carbon atoms, and —$CH_2$-s in the alkyl group may each independently be substituted with —O—, —S—, —CO—, or —CS—, nC11 to nC13 each independently represent an integer of from 0 to 5, and when a plurality of $R^{C11}$s, $R^{C12}$s, or $R^{C13}$s are present in the same molecule, the plurality of groups may be identical to or different from each other, $X^{C11}$ to $X^{C13}$ each independently represent —O— or —S—, and $X^{C14}$ represents =O or =S.

$R^{C11}$ to $R^{C13}$ each independently represent a hydrocarbon group having 1 or more and 24 or less carbon atoms. The hydrocarbon group is more preferably an alkyl group having 1 or more and 8 or less carbon atoms, still more preferably an alkyl group having 1 or more and 6 or less carbon atoms, still further more preferably an alkyl group having 1 or more and 4 or less carbon atoms.

nC11 to nC13 each independently represent preferably an integer of from 0 to 3, more preferably an integer of from 0 to 2, still more preferably 0 or 1. $X^{C11}$ to $X^{C13}$ each preferably represent —O—.

To obtain a more excellent gear-protecting property, the lower limit value of a phosphorus atom content in the phosphorus-based extreme pressure agent (C) is preferably 1.00 mass % or more, more preferably 3.00 mass % or more, still more preferably 6.00 mass % or more, and the upper limit value thereof is preferably 15.00 mass % or less, more preferably 13.00 mass % or less, still more preferably 10.00 mass % or less.

To improve the gear-protecting property of the lubricating oil composition, the lower limit value of the content of the phosphorus-based extreme pressure agent (C) is preferably 0.01 mass %, more preferably 0.03 mass %, still more preferably 0.05 mass %, still further more preferably 0.10 mass % with respect to the total amount (100 mass %) of the lubricating oil composition. In addition, to express an excellent copper corrosion-preventing property and excellent oxidation stability, the upper limit value thereof is preferably 3.00 mass %, more preferably 2.00 mass %, still more preferably 1.00 mass %, still further more preferably 0.70 mass %, even more preferably 0.50 mass %.

The content of phosphorus atoms derived from the phosphorus-based extreme pressure agent (C) is preferably 100 mass ppm or more and 500 mass ppm or less with respect to the total amount (100 mass %) of the lubricating oil composition because an excellent copper corrosion-preventing property and excellent oxidation stability can be achieved while the gear-protecting property is improved. The lower limit value of the content is more preferably 120 mass ppm or more, still more preferably 140 mass ppm or more. The upper limit value thereof is more preferably 450 mass ppm or less, still more preferably 400 mass ppm or less, still further more preferably 350 mass ppm or less.

To improve the gear-protecting property of the lubricating oil composition, the lower limit value of the total content of the sulfur-based extreme pressure agent (B) and the phosphorus-based extreme pressure agent (C) is preferably 0.01 mass % or more, more preferably 0.05 mass % or more, still more preferably 0.10 mass % or more, still further more preferably 0.20 mass % or more with respect to the total amount (100 mass %) of the lubricating oil composition. In addition, to express an excellent copper corrosion-preventing property and excellent oxidation stability, the upper limit value thereof is preferably 3.00 mass % or less, more preferably 2.00 mass % or less, still more preferably 1.00 mass % or less, still further more preferably 0.80 mass % or less, even more preferably 0.60 mass % or less.

To achieve a more excellent copper corrosion-preventing property and more excellent oxidation stability while achieving both of a reduction in viscosity of the lubricating oil composition and the gear-protecting property thereof at high levels, the lower limit value of a value obtained by multiplying a value, which is obtained by dividing the total content of the sulfur-based extreme pressure agent (B) and the phosphorus-based extreme pressure agent (C) by the content of the base oil (A), by 100 is preferably 0.10 or more, more preferably 0.20 or more, still more preferably 0.30 or more. In addition, to express an excellent copper corrosion-preventing property and excellent oxidation stability, the upper limit value thereof is preferably 1.00 or less, more preferably 0.80 or less, still more preferably 0.70 or less, still further more preferably 0.60 or less.

The lubricating oil composition may include only the base oil (A), the sulfur-based extreme pressure agent (B), and the phosphorus-based extreme pressure agent (C), may include any other additive to be described later, or may include only the base oil (A), the sulfur-based extreme pressure agent (B), the phosphorus-based extreme pressure agent (C), and the other additive to be described later.

<Other Additive>

The lubricating oil composition of this embodiment may further include, as any other additive, at least one kind selected from any other sulfur-based extreme pressure agent, any other phosphorus-based extreme pressure agent, a viscosity index improver, an antioxidant, a pour point depressant, a detergent, a friction modifier, an antifoaming agent, and a dispersant each of which can improve its quality as a product.

To achieve a more excellent copper corrosion-preventing property and more excellent oxidation stability while achieving both of a reduction in viscosity of the lubricating oil composition and the gear-protecting property thereof at high levels, the lower limit value of the content of the mixture of the other additives is preferably 0.10 mass % or more, more preferably 1.00 mass % or more, still more preferably 3.00 mass % or more, still further more preferably 5.00 mass % or more, even more preferably 8.00 mass % or more with respect to the total amount (100 mass %) of the lubricating oil composition. In addition, the upper limit thereof is preferably 40.00 mass % or less, more preferably 30.00 mass % or less, still more preferably 20.00 mass % or less, still further more preferably 15.00 mass % or less, even more preferably 12.00 mass % or less, still even more preferably 11.00 mass % or less.

The term "mixture of the other additives" as used herein does not mean only the addition of the other additives as a mixture to the lubricating oil composition, and includes a case in which only one kind of the other additives is used. When the respective other additives added to the lubricating oil composition are turned into a mixture, their content represents a content with respect to the total amount of the lubricating oil composition.

(Other Sulfur-Based Extreme Pressure Agent)

The lubricating oil composition of this embodiment may further include the other sulfur-based extreme pressure agent different from the sulfur-based extreme pressure agent (B). However, from the viewpoint of facilitating the exhibition of the effects of the present invention, the content of the other sulfur-based extreme pressure agent is preferably as small as possible.

The content of the other sulfur-based extreme pressure agent is preferably less than 0.10 mass %, more preferably less than 0.05 mass %, still more preferably less than 0.01 mass % with respect to the total amount (100 mass %) of the lubricating oil composition. The composition is still further more preferably free of the other sulfur-based extreme pressure agent.

For example, the other sulfur-based extreme pressure agent is a thiadiazole free of a branched organic group having 3 or more and 24 or less carbon atoms in its structure, and is a thiadiazole having a linear organic group. Examples thereof include compounds represented by the general formulae (B1) to (B3) in which $R^{B11}$ to $R^{B32}$ each independently represent a linear organic group having 1 or more and 24 or less carbon atoms, and nB11 to nB32 each independently represent an integer of from 1 to 4.

(Other Phosphorus-Based Extreme Pressure Agent)

The lubricating oil composition of this embodiment may further include the other phosphorus-based extreme pressure agent different from the phosphorus-based extreme pressure agent (C). However, from the viewpoint of facilitating the exhibition of the effects of the present invention, the content of the other phosphorus-based extreme pressure agent is preferably as small as possible.

The content of the other phosphorus-based extreme pressure agent is preferably less than 0.47 mass %, more preferably less than 0.20 mass %, still more preferably less than 0.10 mass %, still further more preferably less than 0.01 mass % with respect to the total amount (100 mass %) of the lubricating oil composition. The composition is even more preferably free of the other phosphorus-based extreme pressure agent.

The other phosphorus-based extreme pressure agent is a phosphate ester free of a ring structure in its structure, and is specifically a phosphate ester having 6 or more and 24 or less carbon atoms, the ester being free of a ring structure in its structure. More specific examples thereof include: phosphate ester compounds, such as a neutral phosphate ester, an acidic phosphate ester, a phosphite ester, and a hydrogen phosphite ester that are free of ring structures in their structures; and amine salts of the phosphate ester compounds. The content of an acidic phosphate ester free of a ring structure in its structure or an amine salt thereof among them is preferably as small as possible. A specific content of the acidic phosphate ester free of a ring structure in its structure or the amine salt thereof is the same as the specific content of the other phosphorus-based extreme pressure agent. The other phosphorus-based extreme pressure agents may be used alone or in combination thereof.

Examples of the phosphate ester free of a ring structure in its structure include tributyl phosphate, ethyldibutyl phosphate, trihexyl phosphate, tri(2-ethylhexyl)phosphate, tridecyl phosphate, trilauryl phosphate, trimyristyl phosphate, tripalmityl phosphate, tristearyl phosphate, and trioleyl phosphate.

Examples of the acidic phosphate ester free of a ring structure in its structure include mono(di)ethyl acid phosphate, mono(di)-n-propyl acid phosphate, mono(di)-2-ethylhexyl acid phosphate, mono(di)butyl acid phosphate, mono(di)oleyl acid phosphate, mono(di)isodecyl acid phosphate, mono(di)lauryl acid phosphate, mono(di)stearyl acid phosphate, and mono(di)isostearyl acid phosphate.

Examples of the phosphite ester free of a ring structure in its structure include triethyl phosphite, tributyl phosphite, tri(2-ethylhexyl) phosphite, tridecyl phosphite, trilauryl phosphite, triisooctyl phosphite, tristearyl phosphite, and trioleyl phosphite.

Examples of the hydrogen phosphite ester free of a ring structure in its structure include mono(di)ethyl hydrogen phosphite, mono(di)-n-propyl hydrogen phosphite, mono (di)-n-butyl hydrogen phosphite, mono(di)-2-ethylhexyl hydrogen phosphite, mono(di)lauryl hydrogen phosphite, mono(di)oleyl hydrogen phosphite, and mono(di)stearyl hydrogen phosphite.

In addition, preferred examples of the amine salts of the phosphate ester compounds, such as the phosphate ester, the acidic phosphate ester, the phosphite ester, and the hydrogen phosphite ester that are free of ring structures in their structures, include amine salts formed from these phosphate ester compounds and amines. In this case, examples of the amine to be used in the formation of the amine salt include a primary amine, a secondary amine, a tertiary amine, and a polyalkyleneamine. Examples of the primary amine, the secondary amine, and the tertiary amine include ethylenediamine, diethylenetriamine, triethylenetetramine, tetraethylenepentamine, pentaethylenehexamine, hexaethyleneheptamine, heptaethyleneoctamine, tetrapropylenepentamine, and hexabutyleneheptamine.

(Viscosity Index Improver)

The lubricating oil composition of this embodiment preferably further includes the viscosity index improver. A case in which the viscosity index improver is incorporated is preferred because of the following reason: even when the kinematic viscosity of the lubricating oil composition is reduced, a reduction in oil film formability thereof at high temperature can be suppressed, and hence a reduction in gear-protecting property thereof at high temperature hardly occurs.

Examples of the viscosity index improver include polymers, such as a nondispersive polymethacrylate, a dispersive polymethacrylate, and a styrene-based copolymer (e.g., a styrene-diene copolymer or a styrene-isoprene copolymer).

The mass-average molecular weight (Mw) of the viscosity index improver is appropriately set in accordance with its kind. However, from the viewpoint of the viscosity characteristic of the lubricating oil composition, the mass-average molecular weight is preferably 500 or more and 1,000,000 or less, more preferably 5,000 or more and 800,000 or less, still more preferably 10,000 or more and 600,000 or less.

In the case of each of the nondispersive and dispersive polymethacrylates, the Mw is preferably 5,000 or more and 300,000 or less, more preferably 10,000 or more and 100,000 or less, still more preferably 20,000 or more and 50,000 or less.

The Mw may be measured by, for example, gel permeation chromatography (GPC) in terms of standard polystyrene.

(Antioxidant)

The lubricating oil composition of this embodiment preferably further includes the antioxidant. The incorporation of the antioxidant can achieve an excellent copper corrosion-preventing property and excellent oxidation stability.

The antioxidant is preferably an amine-based antioxidant or a phenol-based antioxidant.

Examples of the amine-based antioxidant include dioctyldiphenylamine, phenyl-α-naphthylamine, diphenylamine, dinonyldiphenylamine, monobutylphenylmonoctylphenylamine, p-tert-octylphenyl-1-naphthylamine, and 4,4'-bis (α,α-dimethylbenzyl)diphenylamine.

The phenol-based antioxidant preferably has a hindered phenol structure, and examples thereof may include 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 4,4'-methylenebis(2,6-di-tert-butylphenol), 4,4'-bis(2,6-di-tert-butylphenol), 4,4'-isopropylidenebis(2,6-di-tert-butylphenol), tridecyl-3-(3,5-di-tert-butyl-4-hydroxyphenyl)propionate, pentaerythritol tetrakis[3-(3,5-di-tert-butyl-4-hydroxyphenyl) propionate], octyl-3-(3,5-di-tert-butyl-4-hydroxyphenyl)propionate, octadecyl-3-(3,5-di-tert-butyl-4-hydroxyphenyl)propionate, and octyl-3-(3-methyl-5-tert-butyl-4-hydroxyphenyl)propionate.

(Pour Point Depressant)

The lubricating oil composition of this embodiment preferably further includes the pour point depressant. Examples of the pour point depressant include polymers, such as an ethylene-vinyl acetate copolymer, a condensate of chlorinated paraffin and naphthalene, a condensate of chlorinated paraffin and phenol, a polymethacrylate (PMA), and a polyalkylstyrene. Among them, a polymethacrylate is preferred. The weight-average molecular weight (Mw) of each of those polymers is preferably 50,000 or more and 150,000 or less.

The Mw may be measured by, for example, gel permeation chromatography (GPC) in terms of standard polystyrene.

(Detergent)

The lubricating oil composition of this embodiment preferably further includes the detergent. Examples of the detergent include metal-based detergents, such as salicylates, sulfonates, and phenates of sodium, calcium, and magnesium. Among them, calcium sulfonate is more preferred.

Those detergents may be used alone or in combination thereof.

(Friction Modifier)

The lubricating oil composition of this embodiment preferably further includes the friction modifier. The friction modifier is preferably an ashless friction modifier. Examples of the ashless compound include an amine-based friction modifier, an ester-based friction modifier, an amide-based friction modifier, a fatty acid-based friction modifier, an alcohol-based friction modifier, an ether-based friction modifier, a urea-based friction modifier, and a hydrazide-based friction modifier. The lubricating oil composition includes preferably at least one selected from the amine-based friction modifier, the ester-based friction modifier, and the amide-based friction modifier, more preferably the amine-based friction modifier. Although an amine-based friction modifier typically used in the field of the lubricating oil composition may be used as the amine-based friction modifier, a secondary amine is more preferred.

(Antifoaming Agent)

The lubricating oil composition of this embodiment preferably further includes the antifoaming agent. Examples of the antifoaming agent include: a silicone-based antifoaming agent; a fluorine-based antifoaming agent, such as a fluorosilicone oil or a fluoroalkyl ether; and a polyacrylate-based antifoaming agent. Among them, a silicone-based antifoaming agent is preferred.

(Dispersant)

The lubricating oil composition of this embodiment preferably further includes the dispersant. Examples of the dispersant include ashless dispersants, such as boron-free succinimides, boron-containing succinimides, benzylamines, boron-containing benzylamines, succinate esters, and amides of monovalent or divalent carboxylic acids typified by fatty acids or succinic acid. Among them, boron-free succinimides or boron-containing succinimides are more preferred, a boron-free polyalkenyl succinimide or a boron-containing polyalkenyl succinimide is still more preferred, and polybutenyl succinimide or boron-containing polybutenyl succinimide is still further more preferred. The polyalkenyl succinimide or the boron-containing polyalkenyl succinimide is preferably a compound having a mass-average molecular weight (Mw) of 500 or more and 2,000 or less, more preferably a compound having a Mw of 750 or more and 1,500 or less, still more preferably a compound having a Mw of 800 or more and 1,200 or less. In addition, the number of the carbon atoms of the alkenyl group of the dispersant is preferably 2 or more and 8 or less, more preferably 3 or more and 5 or less.

The Mw may be measured by, for example, gel permeation chromatography (GPC) in terms of standard polystyrene.

Those dispersants may be used alone or in combination thereof.

[Lubrication Method and Transmission]

The lubricating oil composition of this embodiment can achieve a more excellent copper corrosion-preventing property and more excellent oxidation stability while achieving both of a reduction in viscosity and a gear-protecting property at high levels. Accordingly, the lubricating oil composition of this embodiment may be used as a lubricating oil composition for a drive system device, such as a damper, a transmission, or power steering, for a transmission among them, in particular, for a transmission for a gasoline automobile, a hybrid automobile, an electric automobile, or the like. In particular, the composition may be suitably used as a lubricating oil composition for a transmission for a hybrid automobile or an electric automobile.

The lubrication method of this embodiment is a lubrication method including using the lubricating oil composition, and the transmission of this embodiment is a transmission including the lubricating oil composition. The lubrication method including using the lubricating oil composition of this embodiment and the transmission including the lubricating oil composition of this embodiment as a constituent therefor as described above each achieve a more excellent copper corrosion-preventing property and more excellent oxidation stability while achieving both of a reduction in viscosity and a gear-protecting property at high levels.

In addition, preferred examples of other applications to which the lubricating oil composition of this embodiment is applicable include an internal combustion engine oil, a hydraulic oil, a turbine oil, a compressor oil, a lubricating oil for a machine tool, a cutting oil, a gear oil, a fluid bearing oil composition, and a roller bearing oil.

In addition, according to this embodiment, there is provided a use of the above-mentioned lubricating oil composition as a lubricating oil for a transmission.

EXAMPLES

Next, the present invention is described in more detail by way of Examples. However, the present invention is by no means limited by these examples.

Examples 1 to 6 and Comparative Examples 1 to 5

Lubricating oil compositions were prepared in accordance with blending amounts (mass %) shown in Tables 1 and 2. The resultant lubricating oil compositions were subjected to various tests by the following methods, and their physical properties were evaluated. The evaluation results are shown in Tables 3 and 4.

The properties of the lubricating oil compositions were measured by the following methods.

(1) Kinematic Viscosity at 40° C. (40° C. Kinematic Viscosity), Kinematic Viscosity at 100° C. (100° C. Kinematic Viscosity), and Viscosity Index The kinematic viscosities of each of the compositions at 40° C. and 100° C. were measured in conformity with JIS K2283:2000, and the viscosity index thereof was calculated.

(2) Viscosity Index (VI)

The calculation was performed in conformity with ASTM D2270.

(3) Acid Value

The acid values of the lubricating oil compositions were measured in conformity with JIS K2501 by an indicator photometric titration method (see Annex 1 in the above-mentioned JIS standard). The acid values of each of the lubricating oil compositions before and after an ISOT test for evaluating a copper elution amount to be described later were measured, and a difference therebetween was defined as an acid value increase. A smaller value of the acid value increase means that the composition is more excellent in oxidation stability.

(4) Sulfur Atom Content

The sulfur atom contents of the compositions were measured in conformity with JIS K2541-6.

(5) Phosphorus Atom Content

The phosphorus atom contents of the compositions were measured in conformity with ASTM D4951.

(6) Shell Four-Ball Wear Test (Shell Wear)

Each of the compositions was subjected to a test in conformity with ASTM D4172-18 under the conditions of 80° C., 1,200 rpm, 392 N, and 30 minutes, and the diameter (mm) of a wear scar was measured.

The fact that surface damage occurred was recognized by observing the wear scar with a microscope, and the extent of the damage was recognized from the size of the wear scar diameter. A smaller wear scar diameter means that the composition is more excellent in gear-protecting property (wear resistance).

(7) Copper Elution Amount (Cu Elution)

An ISOT test was performed in conformity with JIS K-2514-1 (2013) "Lubricating Oil-Oxidation Stability Test." That is, an iron-copper plate was loaded into an oil, and the oil was stirred at 150° C., followed by the measurement of a copper elution amount (mass ppm) 72 hours thereafter by ASTM D4951. A smaller copper elution amount means that the oil is more excellent in copper corrosion-preventing property.

TABLE 1

| | | Example 1 | Example 2 | Example 3 | Example 4 | Example 5 | Example 6 |
|---|---|---|---|---|---|---|---|
| Base oil (A) | Mineral oil (1) | 45.00 | 45.00 | 45.00 | 45.00 | 45.00 | 45.00 |
| | Mineral oil (2) | 44.95 | 45.60 | 44.45 | 44.45 | 44.55 | 45.80 |
| Total of base oils | | 89.95 | 90.60 | 89.45 | 89.45 | 89.55 | 90.80 |
| Sulfur-based extreme pressure agent (B) | Thiadiazole (branched chain) | 0.10 | 0.10 | 0.10 | 0.10 | 0.10 | 0.20 |
| | Thiadiazole (linear) | | | | | | |
| | Benzotriazole | | | | | | |
| Phosphorus-based extreme pressure agent (C) | Phosphorus-based compound (1) | 0.40 | 0.20 | | | | |
| | Phosphorus-based compound (2) | | | 0.40 | | | 0.20 |
| | Phosphorus-based compound (3) | | | | 0.40 | | |
| | Phosphorus-based compound (4) | | | | | 0.30 | |
| | Acidic phosphate extreme pressure agent | | | | | | |
| Mixture of other additives | | 9.55 | 9.10 | 10.05 | 10.05 | 10.05 | 8.80 |
| | Total | 100.00 | 100.00 | 100.00 | 100.00 | 100.00 | 100.00 |
| | (A) + (B) + (C) | 90.45 | 90.90 | 89.95 | 89.95 | 89.95 | 91.20 |
| | (B) + (C) | 0.50 | 0.30 | 0.50 | 0.50 | 0.40 | 0.40 |
| | ((B) + (C)) × 100/(A) | 0.56 | 0.33 | 0.56 | 0.56 | 0.45 | 0.44 |

TABLE 2

| | | Comparative Example 1 | Comparative Example 2 | Comparative Example 3 | Comparative Example 4 | Comparative Example 5 |
|---|---|---|---|---|---|---|
| Base oil (A) | Mineral oil (1) | 45.00 | 45.00 | 45.00 | 45.00 | 45.00 |
| | Mineral oil (2) | 44.45 | 44.45 | 44.55 | 44.50 | 44.38 |
| Total of base oils | | 89.45 | 89.45 | 89.55 | 89.50 | 89.38 |
| Sulfur-based extreme pressure agent (B) | Thiadiazole (branched chain) | | | | | 0.10 |
| | Thiadiazole (linear) | 0.10 | 0.10 | 0.10 | | |
| | Benzotriazole | | | | 0.05 | |
| Phosphorus-based extreme pressure agent (C) | Phosphorus-based compound (1) | | | | | |
| | Phosphorus-based compound (2) | 0.40 | | | 0.40 | |
| | Phosphorus-based compound (3) | | 0.40 | | | |
| | Phosphorus-based compound (4) | | | 0.30 | | |

TABLE 2-continued

| | Comparative Example 1 | Comparative Example 2 | Comparative Example 3 | Comparative Example 4 | Comparative Example 5 |
|---|---|---|---|---|---|
| Acidic phosphate extreme pressure agent | | | | | 0.47 |
| Mixture of other additives | 10.05 | 10.05 | 10.05 | 10.05 | 10.05 |
| Total | 100.00 | 100.00 | 100.00 | 100.00 | 100.00 |
| (A) + (B) + (C) | 89.85 | 89.85 | 89.85 | 89.90 | 89.48 |
| (B) + (C) | 0.40 | 0.40 | 0.30 | 0.40 | 0.10 |
| ((B) + (C)) × 100/(A) | 0.45 | 0.45 | 0.34 | 0.45 | 0.11 |

In Tables 1 and 2, the symbols "(A)", "(B)", and "(C)" represent the contents of the base oil (A), the sulfur-based extreme pressure agent (B), and the phosphorus-based extreme pressure agent (C) with respect to the total amount (100 mass %) of each of the lubricating oil compositions, respectively. A blank means that the corresponding component is not incorporated. In Tables 3 and 4, the row "S/P" shows a mass ratio between sulfur atoms and phosphorus atoms in each of the lubricating oil compositions.

TABLE 5

| | | Mineral oil (1) | Mineral oil (2) |
|---|---|---|---|
| 40° C. kinematic viscosity | $mm^2/s$ | 7.900 | 19.700 |
| 100° C. kinematic viscosity | $mm^2/s$ | 2.300 | 4.200 |
| Viscosity index | | 102 | 124 |

TABLE 3

| | | Example 1 | Example 2 | Example 3 | Example 4 | Example 5 | Example 6 |
|---|---|---|---|---|---|---|---|
| 40° C. kinematic viscosity | $mm^2/s$ | 15.86 | 15.61 | 15.65 | 15.55 | 15.80 | 15.74 |
| 100° C. kinematic viscosity | $mm^2/s$ | 4.010 | 3.985 | 4.007 | 3.949 | 3.999 | 3.990 |
| Viscosity index | — | 160 | 162 | 164 | 158 | 159 | 160 |
| Acid value | mgKOH/g | 0.11 | 0.09 | 0.10 | 0.09 | 0.10 | 0.11 |
| Sulfur atom content | mass % | 0.04 | 0.04 | 0.04 | 0.04 | 0.07 | 0.08 |
| Phosphorus atom content | mass % | 0.030 | 0.015 | 0.030 | 0.033 | 0.030 | 0.015 |
| S/P | | 1.33 | 2.67 | 1.33 | 1.21 | 2.33 | 5.33 |
| Shell wear | mm | 0.52 | 0.40 | 0.51 | 0.46 | 0.50 | 0.47 |
| After ISOT | | | | | | | |
| Acid value | mgKOH/g | 0.13 | 0.18 | 0.13 | 0.13 | 0.15 | 0.18 |
| Acid value increase | mgKOH/g | 0.02 | 0.09 | 0.03 | 0.04 | 0.05 | 0.07 |
| Cu elution | mass ppm | 32 | 12 | 28 | 36 | 31 | 15 |

TABLE 4

| | | Comparative Example 1 | Comparative Example 2 | Comparative Example 3 | Comparative Example 4 | Comparative Example 5 |
|---|---|---|---|---|---|---|
| 40° C. kinematic viscosity | $mm^2/s$ | 15.77 | 15.55 | 15.76 | 15.60 | |
| 100° C. kinematic viscosity | $mm^2/s$ | 4.002 | 3.990 | 3.990 | 3.968 | |
| Viscosity index | — | 160 | 164 | 159 | 160 | |
| Acid value | mgKOH/g | 0.11 | 0.10 | 0.10 | 0.11 | |
| Sulfur atom content | mass % | 0.04 | 0.04 | 0.07 | 0.04 | |
| Phosphorus atom content | mass % | 0.030 | 0.030 | 0.030 | 0.030 | |
| S/P | | 1.33 | 1.33 | 2.33 | 1.33 | |
| Shell wear | mm | 0.76 | 0.70 | 0.79 | 0.99 | |
| After ISOT | | | | | | |
| Acid value | mgKOH/g | 0.23 | 0.25 | 0.21 | 0.09 | |
| Acid value increase | mgKOH/g | 0.12 | 0.15 | 0.11 | −0.02 | |
| Cu elution | mass ppm | 67 | 53 | 64 | 9 | |

In Tables 3 and 4, acid values, acid value increases, and copper elution amounts shown below the row "After ISOT" are numerical values after the ISOT tests.

Thiadiazole (branched chain): a compound represented by the formula (B-1) (having a branched organic group having 12 carbon atoms)

(B-1)

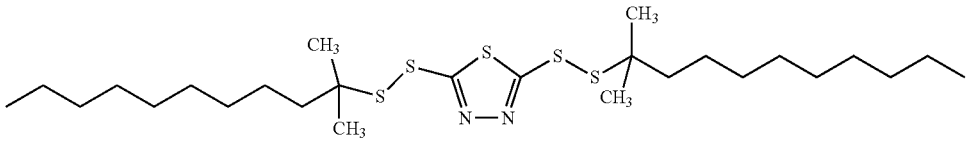

Thiadiazole (linear): a mixture of compounds each represented by the general formula (B-2)

(B-2)

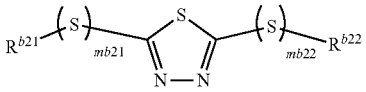

wherein $R^{b21}$ and $R^{b22}$ each independently represent a linear alkyl group having 6 or more and 10 or less carbon atoms, and mb21 and mb22 each independently represent an integer of from 1 to 4.

Benzotriazole: a mixture of compounds each represented by the general formula (BT)

(BT)

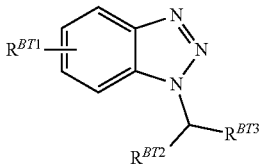

wherein $R^{BT1}$ represents a linear alkyl group having 1 or more and 4 or less carbon atoms, or a hydrogen atom, and $R^{BT2}$ and $R^{BT3}$ each independently represent a linear alkyl group having 1 or more and 20 or less carbon atoms, or a hydrogen atom.

Phosphorus-based compound (1): a compound represented by the formula (C-1) (having a ring structure-containing organic group having 6 or 10 carbon atoms)

Phosphorus-based compound (2): a compound represented by the formula (C-2) (having a ring structure-containing organic group having 9 carbon atoms)

Phosphorus-based compound (3): a compound represented by the formula (C-3) (having a ring structure-containing organic group having 7 carbon atoms)

Phosphorus-based compound (4): a compound represented by the formula (C-4) (having a ring structure-containing organic group having 6 carbon atoms)

(C-1)

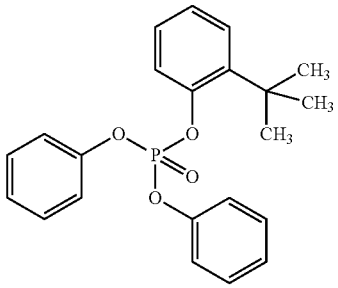

-continued (C-2)

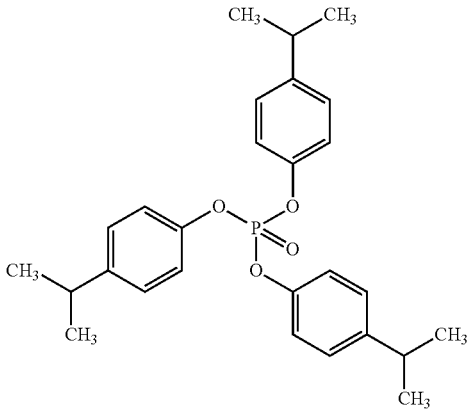

(C-3)

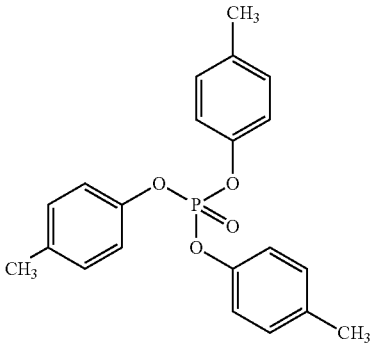

(C-4)

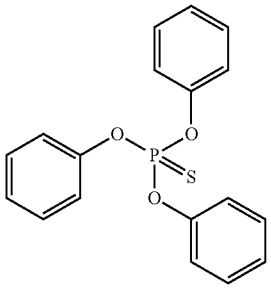

Acidic Phosphate Extreme Pressure Agent: Dilauryl Acid Phosphate Mixture of other additives: a viscosity index improver, an antioxidant, a pour point depressant, a detergent, a friction modifier, an antifoaming agent, a dispersant, and the like.

As is apparent from the results of Table 3, each of the lubricating oil compositions of Examples 1 to 6 had a more excellent copper corrosion-preventing property and more excellent oxidation stability while achieving both of the reduction in viscosity and the gear-protecting property at high levels.

In contrast, as shown in Tables 1 to 4, in each of Comparative Example 1 in which the sulfur-based extreme pressure agent (B) of Example 3 was replaced with the thiadiazole (linear), Comparative Example 2 in which the sulfur-based extreme pressure agent (B) of Example 4 was replaced with the thiadiazole (linear), and Comparative Example 3 in which the sulfur-based extreme pressure agent (B) of Example 5 was replaced with the thiadiazole (linear), it was recognized that the gear-protecting property reduced, and the copper corrosion-preventing property and the oxidation stability also reduced.

In Comparative Example 4 in which the sulfur-based extreme pressure agent (B) of Example 3 was replaced with benzotriazole, it was recognized that no reductions in copper corrosion-preventing property and oxidation stability occurred, but the gear-protecting property largely deteriorated.

In Comparative Example 5 in which the phosphorus-based extreme pressure agent (C) was replaced with the acidic phosphate extreme pressure agent, a uniform lubricating oil composition was able to be obtained. However, precipitation occurred thereafter to make the composition nonuniform, and hence measurement concerning its physical property values was not able to be performed. Accordingly, a practical lubricating oil composition was not obtained.

The invention claimed is:

1. A lubricating oil composition, comprising:

a base oil (A);

a sulfur-based extreme pressure agent (B); and a phosphorus-based extreme pressure agent (C), wherein the sulfur-based extreme pressure agent (B) is a thiadiazole having a branched organic group having 3 or more and 24 or less carbon atoms, wherein the phosphorus-based extreme pressure agent (C) is a neutral phosphate ester having a ring structure-containing organic group having 6 or more and 24 or less carbon atoms, and wherein the lubricating oil composition does not contain an acidic phosphate ester or an amine salt of an acidic phosphate ester.

2. The lubricating oil composition according to claim 1, wherein the base oil (A) has a kinematic viscosity at 100° C. of 6.000 $mm^2/s$ or less.

3. The lubricating oil composition according to claim 1, wherein the base oil (A) contains a mineral oil, and a content of the mineral oil with respect to a total mass of the base oil (A) is 70.00 mass % or more.

4. The lubricating oil composition according to claim 1, wherein the thiadiazole is a compound selected from compounds represented by formulae (B1) to (B3):

(B1)

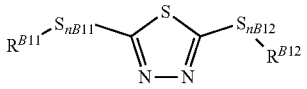

(B2)

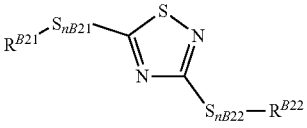

(B3)

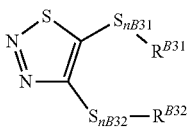

wherein in the formulae (B1) to (B3), $R^{B11}$ to $R^{B32}$ each independently represent a branched organic group having 3 or more and 24 or less carbon atoms, and nB11 to nB32 each independently represent an integer of from 1 to 4.

5. The lubricating oil composition according to claim 1, wherein the ring structure-containing organic group having 6 or more and 24 or less carbon atoms of the neutral phosphate ester is an aryl group that optionally has a substituent.

6. The lubricating oil composition according to claim 1, wherein the neutral phosphate ester is free from being an amine salt.

7. The lubricating oil composition according to claim 1, wherein the neutral phosphate ester is a compound represented by formula (C1):

(C1)

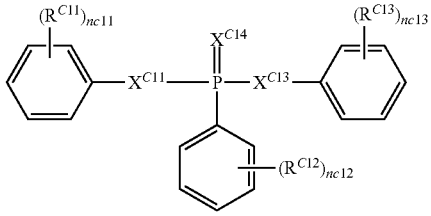

wherein in the formula (C1), $R^{C11}$ to $R^{C13}$ each independently represent a hydrocarbon group having 1 or more and 24 or less carbon atoms, and each —$CH_2$ in the hydrocarbon group is optionally and independently substituted with —O—, —S—, —CO—, or —CS—, nC11 to nC13 each independently represent an integer of from 0 to 5, and when a plurality of $R^{C11}$s, $R^{C12}$s, or $R^{C13}$s are present in the same molecule, the plurality of groups are identical to or different from each other, $X^{C11}$ to $X^{C13}$ each independently represent —O— or —S—, and $X^{C14}$ represents =O or =S.

8. The lubricating oil composition according to claim 1, wherein a sulfur atom content in the lubricating oil composition is 0.01 mass % or more and 0.20 mass % or less with respect to a total mass of the lubricating oil composition.

9. The lubricating oil composition according to claim 1, wherein a phosphorus atom content in the lubricating oil composition is 0.005 mass % or more and 0.100 mass % or less with respect to a total mass of the lubricating oil composition.

10. The lubricating oil composition according to claim 1, wherein S/P, which represents a mass ratio of sulfur atoms to phosphorus atoms in the lubricating oil composition, is 1.00 or more and 7.00 or less.

11. The lubricating oil composition according to claim 1, wherein the lubricating oil composition has a kinematic viscosity at 100° C. of 6.000 $mm^2/s$ or less.

12. The lubricating oil composition according to claim 1, wherein the lubricating oil composition is used for a transmission.

13. A lubrication method, comprising lubricating with the lubricating oil composition according to claim 1.

14. A transmission, comprising the lubricating oil composition according to claim 1.

* * * * *